United States Patent [19]

Schempp et al.

[11] Patent Number: 4,717,344

[45] Date of Patent: Jan. 5, 1988

[54] CONNECTOR FOR CIRCUIT BOARDS

[75] Inventors: Otto Schempp; Martin Herold, both of Heilbronn, Fed. Rep. of Germany

[73] Assignee: Litton Precision Products International GmbH, Heilbronn-Biberach, Fed. Rep. of Germany

[21] Appl. No.: 894,412

[22] Filed: Aug. 7, 1986

[30] Foreign Application Priority Data

Aug. 12, 1985 [DE] Fed. Rep. of Germany ..... 3528912

[51] Int. Cl.[4] ..... H01R 9/09

[52] U.S. Cl. ..... 439/61; 361/407; 439/101

[58] Field of Search ..... 339/17 R, 17 C, 17 L, 339/17 LM, 17 M, 17 LC, 14 R, 143 R, 184 R, 186 R, 186 M; 361/393–396, 407, 413; 439/61, 101

[56] References Cited

U.S. PATENT DOCUMENTS

| | | | |
|---|---|---|---|
| 3,725,843 | 4/1973 | Johnson | 339/17 LM |
| 4,392,705 | 7/1983 | Andrews, Jr. et al. | 339/17 LC |
| 4,472,764 | 9/1984 | Richard et al. | 361/407 |
| 4,521,062 | 6/1985 | Kurbikoff et al. | 339/14 R |

FOREIGN PATENT DOCUMENTS 1790230 1/1972 Fed. Rep. of Germany .

OTHER PUBLICATIONS

Technical Bulletin No. 237, Teradyne Connection Systems, Inc., 1-29-1985.

DIN 41 612, Jun. 1985, (p. 6).

*Primary Examiner*—Neil Abrams

*Attorney, Agent, or Firm*—Brian L. Ribando

[57] ABSTRACT

A daughterboard connector (6) has a polarity key formed by two walls (14, 15) on either side of a recess (12). A lateral contact (8) mounted in the recess engages a bus bar (3, 4) which is mounted in a pair of slots (20) in the end of a motherboard connector (11). A flange (7) adjacent one of the slots forms a polarity key for the motherboard connector. The height and positioning of the lateral contact and the bus bar are chosen to provide a first-make-last-break function for these elements relative to the signal contacts 19 and 16 of the daughterboard and motherboard connectors, respectively. The bus bar (3, 4) may be common to a number of motherboard connectors which are mounted on a common printed circuit board.

16 Claims, 6 Drawing Figures

CONNECTOR FOR CIRCUIT BOARDS

BACKGROUND OF THE INVENTION

This invention relates to printed circuit board connectors having separate power or grounding contacts used for coupling printed circuit boards together.

Various concepts are known for coupling power or ground potential to a plurality of printed circuit boards in electronic equipment, in particular to wired backplanes used in computers—irrespective of the particular type of connector used on the backplane, such as for example wire-wrap connectors, metal-plate connectors, and connectors employing solder or press-in pins. Many such solutions have a common feature; one or more of the signal contacts of the printed circuit board connector are used for transfer of the power or ground potential to the individual daughterboards. It is also known to utilize a separate connection including a bus bar with an additional plug assembly for the power or ground connection.

However, on equipment as increasingly used today in computer installations, the current flowing through the power or ground contacts reaches considerable values; this is particularly true when very fast-switching semiconductor components with metal barrier layers (Schottky barrier devices) are used. Also, when connecting circuit boards together by means of connectors, it is frequently desired to ensure that the power supply or ground connection is made before the signal connections are made. This is known as a first-make-last-break feature. If the power supply is coupled through the normal signal contacts of the printed circuit board connector, several signal contacts have to be used if the current level is high, for which simultaneous and uniform connection to the several contacts has to be guaranteed. Also, since all of the signal contacts in a connector have the same length, the first-make-last-break feature for the signal contacts which are coupling the power or ground potential is difficult to achieve.

While it is known to provide a separate bus bar and plug assembly for power or ground connections, such constructions are obviously more complex and, in some cases, can lead to problems of inadequate space in the equipment.

SUMMARY OF THE INVENTION

The connector system according to the invention offers the special advantage of a direct connection to a bus bar by a slight modification to the polarity key of an existing printed circuit board connector. The invention is characterized by an additional lateral contact on a daughterboard connector which contacts a bus bar on a least one end of a motherboard connector. The bus bar may be coupled to several connectors, through a series of slots in the end of the housing of the motherboard connectors. In order to increase the integrity of the connection made to the bus bar, a bifurcated lateral contact may be used.

To be able to protect against polarity reversal when coupling printed circuit boards together, a polarity key which mates with the motherboard connector is normally provided on the daughterboard connector. The lateral contacts of the invention are positioned within a recess formed in the polarity key, and an opening in the end of the housing of the motherboard connector allows the lateral contacts to connect with the bus bar.

The bus bar itself may be clipped into plastic hooks molded onto the housing of the motherboard connector or may be held by additional clip elements connected to the housing in such a way that the level of the conductor bar can be easily adjusted to ensure that the power or ground contacts of the connectors are coupled before the signal contacts. The first-make-last-break feature is also achieved by making the lateral contacts of the daughterboard connector higher than the signal contacts.

An exemplary embodiment of the invention is described below, with reference to a connector which is made in accordance with the DIN 41612, type R specification, which, according to the invention, is provided with the additional lateral contacts.

DESCRIPTION OF THE PREFERRED EMBODIMENT

Figure 1:
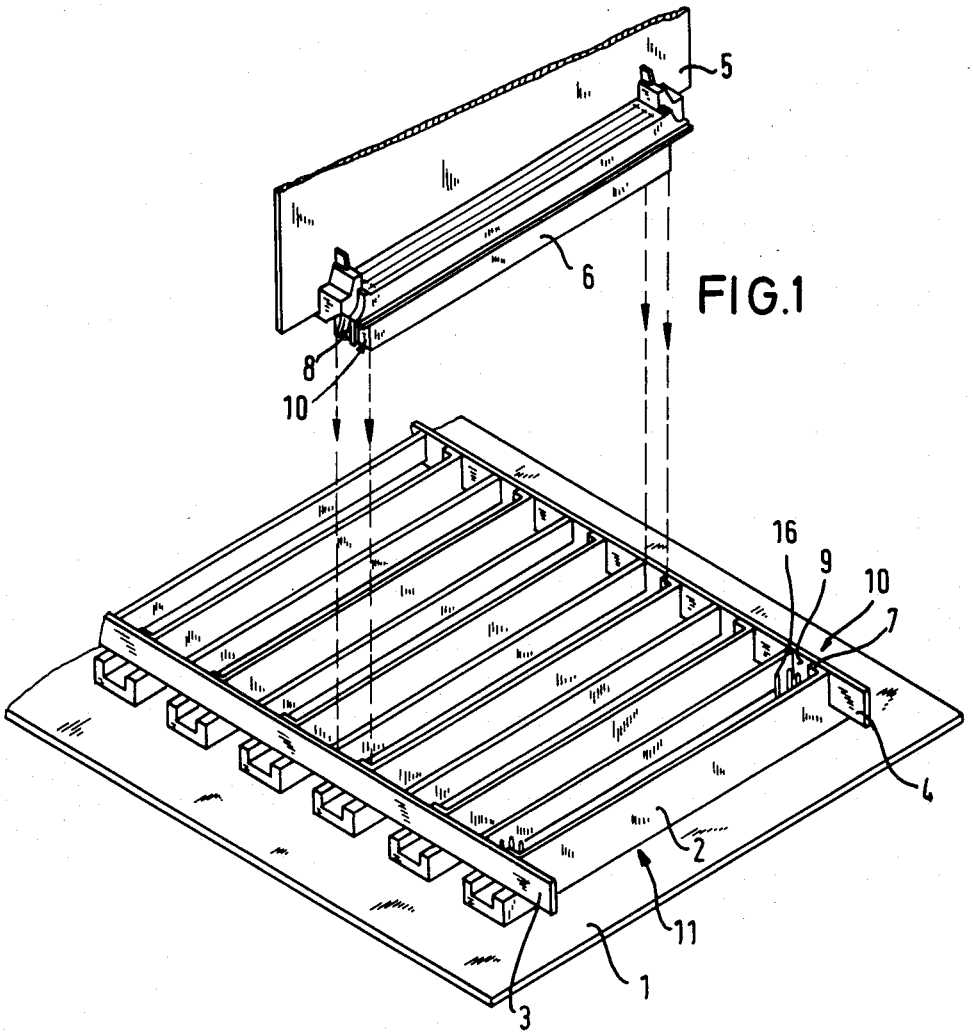
FIG. 1 shows a connector system according to the invention including a backplane or motherboard having a plurality of motherboard connectors, including two conductive bus bars, and a daughterboard having a daughterboard connector attached thereto.

FIG. 1 shows a backplane or motherboard 1 of an electronic computing element, which is fitted with a plurality of motherboard connectors 11. The connectors 11 couple to the motherboard 1 by means of signal pins as is well known in the art. The motherboard connectors 11 are mounted on the upper side of the motherboard 1 equidistant from one another in parallel alignment and the contact pins of which, passing through the motherboard, are wired together on the underside in a way not shown here, for example by the so-called wire-wrap technique. The contact pins 16 of the motherboard connector 11 are surrounded by a housing 2, which is dimensioned to receive a daughterboard connector 6 which is coupled to a daughterboard 5. The daughterboard connector 6, in addition to providing an electrical connection to the daughterboard 5, also provides mechanical mounting and support for the daughterboard.

One or both ends 10 of the motherboard connector 11 is formed with an opening 9. One or two bus bars 3, 4 are mounted along the ends 10 of the connectors 11 and are freely accessible from the inside of the housing 21, by means of the opening 9. Thus, the bus bars 3 are electrically contactable from within the housing 2 in the region of the opening 9. If only one bus bar is required for the power supply of the daughterboard 5, only one opening 9 will be provided in each motherboard connector 11. The bus bars 3, 4 thus form, in the region of the openings 9, conductive housing end walls of the motherboard connectors 11.

Figure 2:
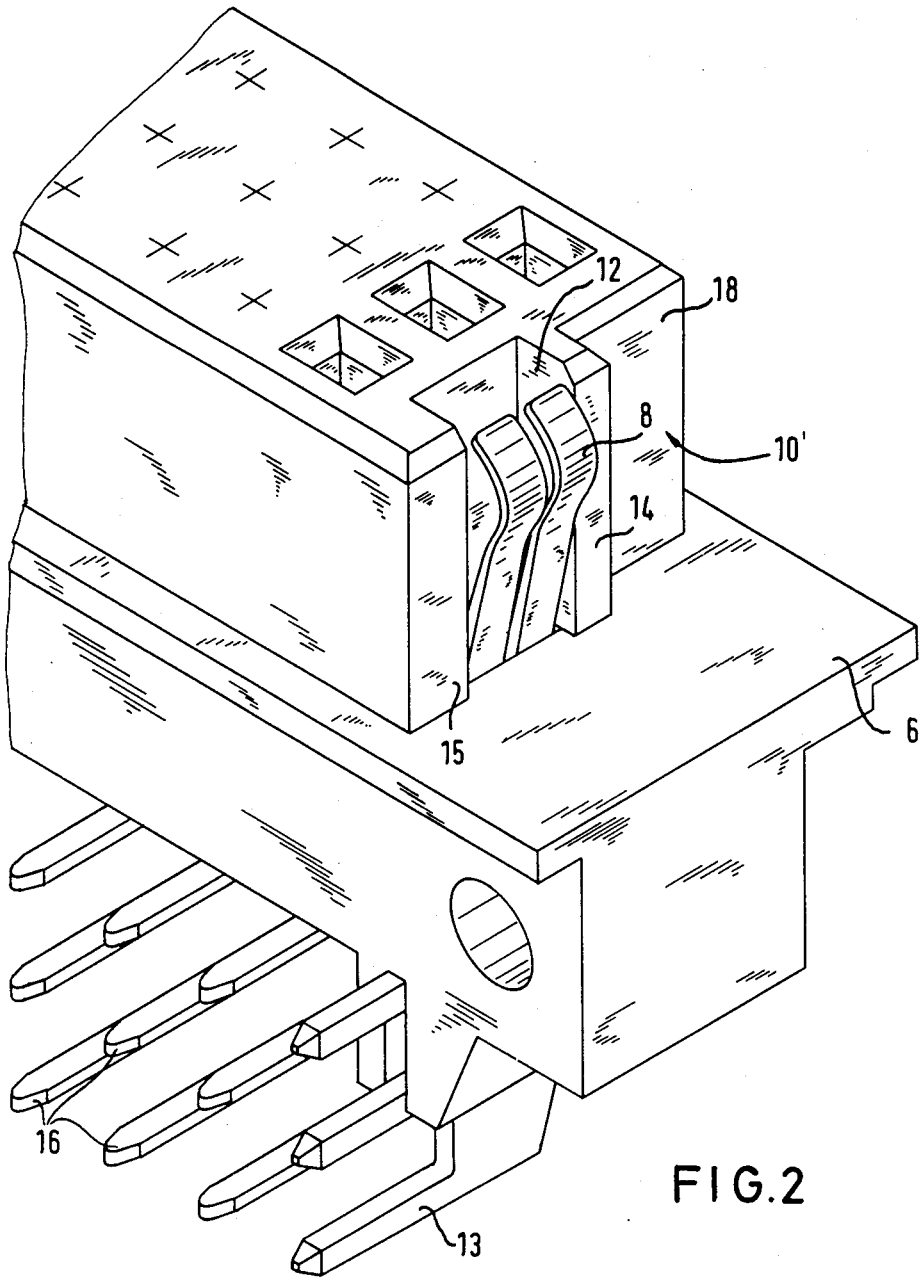
FIG. 2 is a perspective view of an end of the daughterboard connector with features according to the invention.

FIG. 2 shows in detail one end of the daughterboard connector 6. The daughterboard connector 6 is of the right angle type and includes an array of signal contacts 17 which plug into the daughterboard 5. The signal contacts 17 are each coupled to a respective socket contact 19 which is accessible behind the apertured face 21 of the daughterboard connector 6. It will be apparent to those skilled in the art that the socket contacts 19 may also take the form of contact pins.

A recess 12 is formed in a polarity key formed by the two projecting side walls 14 and 15. The recess 12 houses a bifurcated lateral contact 8 which is positioned to provide contact to one of the bus bars 3 or 4 through the opening 9 in the end wall of the motherboard connector 11. As is apparent, a single lateral contact 8, or a trifurcated lateral contact 8 may also be provided. However, for a reliable connection to the bus bar 3 or 4, at least a bifurcated lateral contact 8 should be provided. The height of the lateral contact may advantageously be chosen to be greater than the height of the contacts 19 to provide the first-make-last-break feature for the lateral contact, wherein the lateral contact 8 connects with the bus bar 3 or 4 before the signal contacts 19 and 16 connect. The lateral contact 8 is formed on its opposite end with one or more terminal contact pins 13 which mate with the daughterboard.

The width of the polarity key formed by the two side walls 14, 15 of the chamber 12 corresponds to the width of the opening 9, while a remaining end wall section 18 corresponds to the width of the flange 7 on the end of the motherboard connector 11. Thus, the polarity key formed by the walls 14 and 15 interacts with the flange 7 and the opening 9 of the motherboard connector to prevent polarity reversal of the daughterboard connector 6 with respect to the motherboard connector 11. This insures that each daughterboard 5 with its connector 6 is correctly oriented when mated with the motherboard connector 11.

Figure 3:
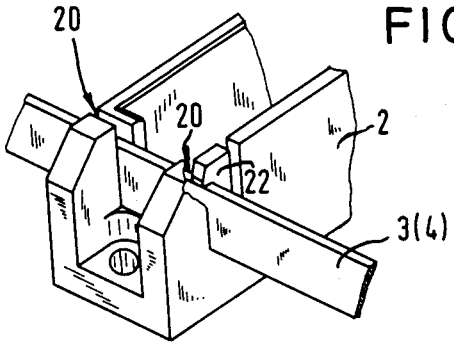
FIGS. 3 to 6 show methods of mounting a bus bar to a motherboard connector.

The bus bars 3 and 4 may be secured by means of contact clips attached to the motherboard connector housing 2, or to the motherboard, or to the housing of the equipment, (not shown), in such a way that the vertical position of the conductor bars 3, 4 relative to the motherboard 1 is adjustable. As shown in FIG. 3, the bus bars may be inserted in receiving slots 20 in the ends of the motherboard connectors 11 and held in place by one or two catch hooks 22 integrally molded into the connector housing 2.

Figure 4:
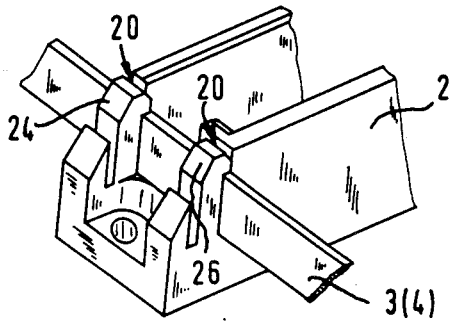

FIG. 4 shows a pair of catch hooks 24 and 26 formed on the end of the connector housing 2 which are used to secure the bus bar 3 within the receiving slots 20.

Figure 5:
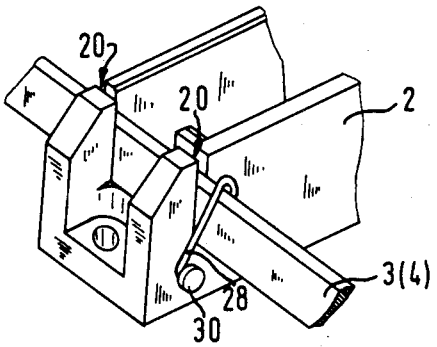
Figure 6:
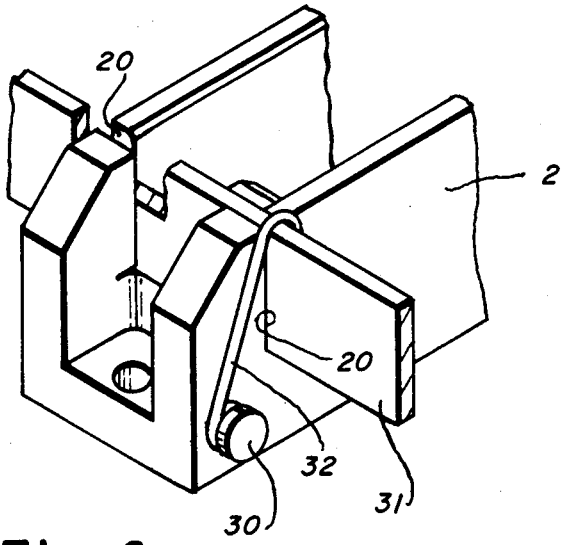

In an alternate embodiment shown in FIG. 5, the bus bar 3 is inserted into end receiving slots 20 formed in the housing 2 of the connector 11. A metallic latch 28 retains the bus bar 3 within the slots 20 and is fixed to the side of the housing 2 by a pivot 30. The height of the bus bar 3 may be increased or decreased by changing the length of the latch 28 so that the bus bar 3 will be held securely in the slots 20. By changing the height of the bus bar 3, the first-make-last-break feature may be insured.

Having thus described the invention, various alterations and modifications thereof will occur to those skilled in the art, which alterations and modifications are intended to be within the scope of the invention as defined in the appended claims.

We claim:

1. A printed circuit board connector for electrically coupling a printed circuit board to a mating element, the connector comprising:

an elongated housing;

a first array of signal contacts mounted in said housing, wherein a first portion of said signal contacts extend out of said housing and a second portion of said signal contacts are surrounded by said housing;

a polarity key means formed on at least one end of the elongated housing and asymmetrically positioned with respect thereto for preventing polarity reversal;

a recess formed in the polarity key means;

a lateral contact mounted in the recess and having a portion which protrudes from said recess; and a termination contact formed on one end of said lateral contact, said termination contact being mounted adjacent the first portion of said signal contacts.

2. The printed circuit board connector of claim 1 further comprising:

a plurality of lateral contacts mounted in said recess, wherein the plurality of lateral contacts are electrically common.

3. The printed circuit board connector of claim 2 further comprising:

a plurality of termination contacts formed on the end of the lateral contacts, wherein the plurality of termination contacts are electrically common.

4. The printed circuit board connector of claim 3 further comprising:

a polarity key means formed on both ends of the elongated housing;

a recess formed in both polarity key means; and a plurality of lateral contacts mounted in each recess.

5. A printed circuit board connector for electrically coupling a printed circuit board to a mating element, the printed circuit board connector comprising:

an elongated insulative housing having two sidewalls;

a first array of signal contacts mounted in the elongated housing;

a pair of aligned slots in the sidewalls of at least one end of the elongated housing;

conductive bar positioned in the pair of slots; and a insulative flange extending from one sidewall of the elongated housing adjacent one of the slots wherein the flange and the conductive bar form an end wall of the elongated housing.

6. The printed circuit board connector of claim 5 wherein the flange and the conductive bar form a polarity key for the connector.

7. The printed circuit board connector of claim 6 further comprising a catch hook formed on the housing adjacent one of the slots, wherein the catch hook prevents removal of the bar from the slots.

8. The printed circuit board connector of claim 6 further comprising:

a pivot formed on the housing adjacent one of the slots; and a metal latch mounted on the pivot, whereby the metal latch may be positioned to prevent removal of the conductive bar from the slots.

9. The printed circuit board connector of claim 8 wherein the metal latch may be changed to accommodate conductive bars of different heights.

10. A printed circuit board connector system for coupling a motherboard to at least one daughterboard, the connector system comprising:

(1) at least one motherboard connector comprising:

(a) an elongated housing of insulating material;

(b) an array of printed circuit board signal contacts mounted at least partially within the interior of the housing;

(c) a pair of slots on at least one end of said elongated housing; and (d) a conductive bar mounted in the pair of slots and having a surface exposed to the interior of the housing; and (2) at least one daughterboard connector comprising:

(a) an elongated housing of insulating material;

(b) an array of printed circuit board signal contacts mounted in the housing; and (c) at least one lateral contact protruding laterally from an end face of the housing, wherein the daughterboard connector is dimensioned to fit within the interior of the motherboard connector with said lateral contact engaging said exposed surface of said conductive bar.

11. The printed circuit board connector system of claim 10 further comprising:

polarity keying means for preventing polarity reversal of the daughterboard with respect to the motherboard, said polarity keying means comprising a protrusion on the end of the daughterboard connector, wherein the lateral contact is mounted in the daughterboard connector at least partially within said protrusion.

12. The printed circuit board connector system of claim 11 further comprising:

a flange formed on the end of the motherboard housing adjacent one of said pair of slots, wherein said flange cooperates with the protrusion on the daughterboard to comprise said polarity keying means.

13. The printed circuit board connector system of claim 12 further comprising:

at least two motherboard connectors each having a pair of slots in at least one end thereof, wherein said conductive bar is mounted in both of said pairs of slots.

14. The printed circuit board connector system of claim 12 further comprising:

means for establishing electrical contact between the lateral contacts of the daughterboard connector and the conductive bar before electrical contact is established between the signal contacts of the daughterboard connector and the signal contacts of the motherboard connector.

15. The printed circuit board connector system of claim 14 wherein the height of the conductive bar is selected whereby the conductive bar engages the lateral contacts before the signal contacts of the motherboard connector engages the signal contacts of the daughterboard connector.

16. The printed circuit board connector of claim 15 wherein conductive bars of different heights may be selectively used.

* * * * *